US009139799B1

(12) United States Patent
Parte et al.

(10) Patent No.: US 9,139,799 B1
(45) Date of Patent: Sep. 22, 2015

(54) SCALE-INHIBITION COMPOSITIONS AND METHODS OF MAKING AND USING THE SAME

(71) Applicant: Diversey, Inc., Sturtevant, WI (US)

(72) Inventors: Anant Kondiram Parte, Mumbai (IN); Prashant Kumar Pandey, Mumbai (IN); Farida Hakim Tinwala, Mumbai (IN)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 14/329,642

(22) Filed: Jul. 11, 2014

(51) Int. Cl.

| | |
|---|---|
| ***C11D 3/30*** | (2006.01) |
| ***C11D 3/33*** | (2006.01) |
| ***C11D 9/34*** | (2006.01) |
| ***C11D 3/00*** | (2006.01) |
| ***C11D 3/37*** | (2006.01) |
| ***C11D 3/36*** | (2006.01) |

(52) U.S. Cl.
CPC ..... *C11D 3/0036* (2013.01); *C11D 3/33* (2013.01); *C11D 3/361* (2013.01); *C11D 3/3757* (2013.01)

(58) Field of Classification Search
CPC ..... C11D 3/30; C11D 3/33; C11D 3/361; C11D 3/3917; C11D 3/3723; C11D 9/34; C11D 11/0023
See application file for complete search history.

(56) References Cited

U.S. PATENT DOCUMENTS

| | | | | |
|---|---|---|---|---|
| 5,053,161 | A * | 10/1991 | Sprague | 252/180 |
| 5,133,892 | A | 7/1992 | Chun et al. | |
| 5,358,655 | A | 10/1994 | Kruse et al. | |
| 5,801,137 | A | 9/1998 | Addison et al. | |
| 6,083,895 | A | 7/2000 | Warwick | |
| 6,162,777 | A | 12/2000 | Gorlin et al. | |
| 6,165,970 | A | 12/2000 | Williams et al. | |
| 6,172,036 | B1 * | 1/2001 | Cruickshank et al. | 510/514 |
| 6,242,406 | B1 | 6/2001 | Katsuda et al. | |
| 6,484,735 | B1 | 11/2002 | Gordon et al. | |
| 7,557,074 | B2 | 7/2009 | Becker et al. | |
| 8,101,027 | B2 | 1/2012 | Vandermeulen et al. | |
| 8,283,301 | B2 | 10/2012 | Manna et al. | |
| 8,303,721 | B2 | 11/2012 | Warkotsch et al. | |
| 8,389,458 | B2 | 3/2013 | Tsumori et al. | |
| 8,440,601 | B2 | 5/2013 | Seebeck et al. | |
| 2002/0032142 | A1 | 3/2002 | Smets et al. | |
| 2003/0027737 | A1 | 2/2003 | Evers | |
| 2009/0209447 | A1 | 8/2009 | Meek et al. | |
| 2010/0154831 | A1 | 6/2010 | Neplenbroek et al. | |
| 2011/0065624 | A1 | 3/2011 | Boutique et al. | |
| 2011/0287997 | A1 * | 11/2011 | Busch et al. | 510/302 |
| 2012/0118321 | A1 | 5/2012 | Neplenbroek et al. | |
| 2012/0196784 | A1 | 8/2012 | Seebeck et al. | |
| 2012/0213759 | A1 | 8/2012 | Karsten et al. | |
| 2012/0304402 | A1 | 12/2012 | Miracle et al. | |
| 2013/0071913 | A1 | 3/2013 | Andersen et al. | |
| 2013/0123161 | A1 | 5/2013 | Randall et al. | |
| 2013/0206181 | A1 | 8/2013 | Giles et al. | |
| 2014/0053877 | A1 | 2/2014 | Letzelter et al. | |
| 2014/0053878 | A1 | 2/2014 | Letzelter et al. | |
| 2014/0065288 | A1 * | 3/2014 | Brown et al. | 426/649 |

FOREIGN PATENT DOCUMENTS

| | | |
|---|---|---|
| WO | WO 00/02982 | 1/2000 |
| WO | WO 01/02528 | 1/2001 |
| WO | 2006/119162 | 11/2006 |
| WO | WO 2008/147940 | 12/2008 |
| WO | WO 2009/006603 | 1/2009 |
| WO | WO 2010/065483 | 6/2010 |
| WO | WO 2012/025740 | 3/2012 |
| WO | WO 2012/028203 | 3/2012 |

OTHER PUBLICATIONS

Evonik Industries AG, "Varisoft 222 LM 90%—Techincal information", dated 2010, pp. 1-4.
Evonik Industries AG, "Varisoft 222 LM 90%—Safety Data Sheet (SDS-US)", dated Mar. 23, 2015, pp. 1-11.
Bhagwati Chemicals, "CODEX DS" <http://www.bhagwatichemicals.com/codex-ds-1806960.html> website publicly available at least as early as May 6, 2014.
AkzoNobel, "Dissolvine® GL Technical brochure," 2010 (16 pages).
ROHM and HAAS, Acusol™ 445/445N/445ND, 2006 (5 pages).
BASF Corporation, "Sokalan® PA 25 CL PN Polyacrylic Acid Dispersant," 2007 (1 page).
BASF Corporation, "Sokalan® PA 30 CL PN Polyacrylic Acid Dispersant," 2004 (1 page).
Kolodynska, D., "Chelating Agents of a New Generation as an Alternative to Conventional Chelators for Heavy Metal Ions Removal from Different Waste Waters," Expanding Issues in Desalination, 2011, 17:339-370.

(Continued)

*Primary Examiner* — Charles Boyer
(74) *Attorney, Agent, or Firm* — Michael Best & Friedrich LLP

(57) ABSTRACT

Provided are scale-inhibition compositions comprising (a) a first acrylic acid polymer having an average molecular weight of about 3000 to about 6000; (b) a second acrylic acid polymer having an average molecular weight of about 6000 to about 10000; (c) an aminocarboxylic acid selected from methylglycine diacetic acid (MGDA), glutamic acid diacetic acid (GLDA), diethylene triamine pentaacetic acid (DTPA), hydroxyethyl ethylene diamine triacetic acid (HEDTA), ethylenediaminetetraacetic acid (EDTA), and a combination thereof; and (d) a phosphonic acid selected from 1-hydroxyethane 1,1-diphosphonic acid (HEDP), amino tris(methylenephosphonic acid) (ATMP), ethylenediamine tetra(methylene phosphonic acid) (EDTMP), tetramethylenediamine tetra(methylene phosphonic acid) (TDTMP), hexamethylenediamine tetra(methylene phosphonic acid) (HDTMP), diethylenetriamine penta(methylene phosphonic acid) (DTPMP), and a combination thereof. The scale-inhibition compositions may be useful in machine ware washing detergents and formulations.

20 Claims, 7 Drawing Sheets

(56) References Cited

OTHER PUBLICATIONS

BASF The Chemical Company, "Safety Data Sheet Sokalan CP 12 S," 2010 (6 pages).
BASF The Chemical Company, "Safety Data Sheet Sokalan CP 5 Granules," 2008 (6 pages).
BASF The Chemical Company, "Safety Data Sheet Sokalan® PA 25 CL PN," 2012 (6 pages).
BASF The Chemical Company, "Safety Data Sheet Sokalan® PA 30 CL," 2006 (6 pages).
Lubrizol, "Carbopol® Ultrez 20 Polymer," Quick Start guide, CP-34, 2006 (2 pages).
Lubrizol, "Carbopol® Ultrez 20 Polymer," Product Specifications, 2006 (2 pages).
Lubrizol, "Carbopol® Ultrez 20 Polymer," Technical Data Sheet, TDS-332, 2006 (2 pages).
Lubrizol, "Carbopol® Polymers for Controlled Release Matrix Tablets," Frequently Asked Questions, 2008 (8 pages).
Lubrizol, "Carbopol® 674 Polymer," Product Specifications, 2010 (1 page).
Lubrizol, "Carbopol® 674 Polymer," Technical Data Sheet, TDS-736, 2010 (2 pages).
Lubrizol, "Guidance Document for Processing Carbopol® Polymers in Oral Solid Dosage Forms," Lubrizol LifeScience Polymers Link Science to Life™, 2013 (8 pages).
Lubrizol, "Carbopol® Polymers Overview," 2008 (41 pages).
Lubrizol, "Carbopol® 674 Polymer," Material Safety Data Sheet, 2013 (5 pages).
Lubrizol, "Molecular Weight of Carbopol® and Pemulen™ Polymers," Technical Data Sheet, TDS-222, 2008 (3 pages).
EVONIK Industries, "Varisoft 222 LM 90%," Material Safety Data Sheet, 2013 (11 pages).
Stepan, "Stepantex® VK 90," Product Bulletin, 2011 (2 pages).
Sigma Aldrich, Arquad® 2HT-75 <http://www.sigmaaldrich.com/catalog/product/aldrich/64402?lang=en&region=US> website publicly available at least as early as May 22, 2014.
Stepan, "Accosoft® 501," Product Bulletin, 2010 (2 pages).
Stepan, "Accosoft® 808," Product Bulletin, 2010 (2 pages).
Rhondia, "Mirapol Surf-S" publicly available at least as early as May 22, 2014 (36 pages).
Stepan, "Accosoft® 550-90 HF," Product Bulletin, 2010 (2 pages).

* cited by examiner

SCALE-INHIBITION COMPOSITIONS AND METHODS OF MAKING AND USING THE SAME

FIELD

Provided are scale-inhibition compositions useful in machine ware washing (MWW) detergents and formulations.

INTRODUCTION

Scale formation on substrates is a common problem encountered when detergents and water containing salts contact a substrate. For example, scale formation is a common problem associated with the use of detergents in ware and dish washing applications. Scales may form when calcium and magnesium salts (e.g., carbonates) found in water and/or detergents crystallize on substrates, or metal ions precipitate on substrates that contact the water and detergents. The formation of calcium and magnesium-based scales, for example, can be attributed to a number of factors, such as the hardness of inlet water, concentration of carbonate ions, other components in the detergent compositions, pH, and temperature. If the calcium and magnesium ions are not sufficiently sequestered, cleaning efficacy is substantially reduced and scales form on the washing machine and the wares.

Historically, phosphates have been used to sequester metal ions (including calcium and magnesium ions), as well as remove food and grease. More recently, however, phosphates have raised environmental concerns.

Another common solution has been to use nitrilotriacetic acid (NTA) sodium salt as a sequestrating agent in MWW formulations. NTA is a strong chelator for calcium and magnesium ions, and has been proven to reduce scales in powders and liquid detergent formulas. More recently, however, there have been suggestions that NTA is potentially carcinogenic.

Accordingly, new scale-inhibition compositions are sought.

SUMMARY

In one aspect, provided are scale-inhibition compositions. The scale inhibition composition may comprise: (a) a first acrylic acid polymer having an average molecular weight of from about 3000 to about 6000; (b) a second acrylic acid polymer having an average molecular weight of from about 6000 to about 10000; (c) an aminocarboxylic acid selected from methylglycine diacetic acid (MGDA), glutamic acid diacetic acid (GLDA), diethylene triamine pentaacetic acid (DTPA), hydroxyethyl ethylene diamine triacetic acid (HEDTA), ethylenediaminetetraacetic acid (EDTA), and a combination thereof; and (d) a phosphonic acid selected from 1,1-diphosphonic acid (HEDP), amino tris(methylenephosphonic acid) (ATMP), ethylenediamine tetra(methylene phosphonic acid) (EDTMP), tetramethylenediamine tetra(methylene phosphonic acid) (TDTMP), hexamethylenediamine tetra(methylene phosphonic acid) (HDTMP), diethylenetriamine penta(methylene phosphonic acid) (DTPMP), and a combination thereof.

In another aspect, provided are methods of reducing scale formation on a surface. The method may comprise contacting the surface with a scale-inhibition composition and drying the surface. The scale-inhibition composition may comprise: (a) a first acrylic acid polymer having an average molecular weight of about 3000 to about 6000; (b) a second acrylic acid polymer having an average molecular weight of about 6000 to about 10000; (c) an amino carboxylic acid selected from methylglycine diacetic acid (MGDA), glutamic acid diacetic acid (GLDA), diethylene triamine pentaacetic acid (DTPA), hydroxyethyl ethylene diamine triacetic acid (HEDTA), ethylenediaminetetraacetic acid (EDTA), and a combination thereof; and (d) a phosphonic acid selected from 1,1-diphosphonic acid (HEDP), amino tris(methylenephosphonic acid) (ATMP), ethylenediamine tetra(methylene phosphonic acid) (EDTMP), tetramethylenediamine tetra(methylene phosphonic acid) (TDTMP), hexamethylenediamine tetra(methylene phosphonic acid) (HDTMP), diethylenetriamine penta(methylene phosphonic acid) (DTPMP), and a combination thereof.

Other aspects of the invention will become apparent by consideration of the detailed description and accompanying drawings.

BRIEF DESCRIPTION OF THE DRAWINGS

FIG. 2A shows the results of visual inspection, which gives a score (marks) to each substrate based on the degree of deposit on the surface of the substrate. FIG. 2B is a photograph showing the level of scale formation, as indicated by the cloudiness on the glass surface. A higher score (marks) in FIG. 2A or a cloudier surface in FIG. 2B indicates higher degree of scale formation and, accordingly, a less effective scale inhibition.

Figure 1:
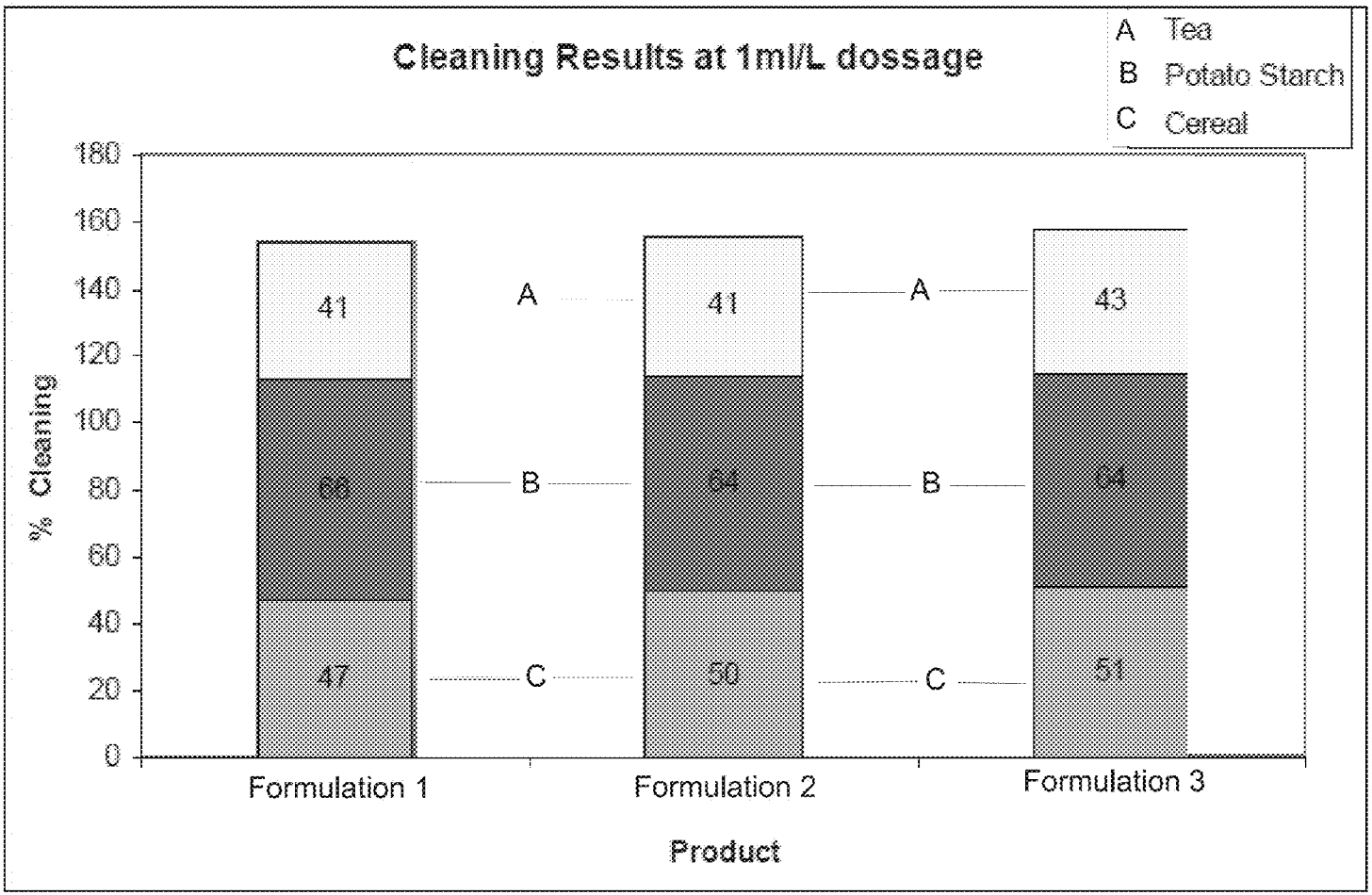
FIG. 1 shows the cleaning performance of a scale-inhibition composition (formulation 3) compared to an NTA-based formulation (formulation 1) and an MGDA-based formulation (formulation 2) according to Example 3.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

DETAILED DESCRIPTION

The use of "including," "comprising," or "having" and variations thereof herein is meant to encompass the items listed thereafter and equivalents thereof as well as additional items. Any numerical range recited herein includes all values from the lower value to the upper value. For example, if a concentration range is stated as 1% to 50%, it is intended that values such as 2% to 40%, 10% to 30%, or 1% to 3%, etc., are expressly enumerated in this specification. These are only examples of what is specifically intended, and all possible combinations of numerical values between and including the lowest value and the highest value enumerated are to be considered to be expressly stated in this application.

The modifier "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1. Other meanings of "about" may be apparent from the context, such as rounding off, so, for example "about 1" may also mean from 0.5 to 1.4.

Definitions of specific functional groups and chemical terms are described in more detail below. For purposes of this disclosure, the chemical elements are identified in accordance with the Periodic Table of the Elements, CAS version, Handbook of Chemistry and Physics, 75$^{th}$ Ed., inside cover, and specific functional groups are generally defined as described therein. Additionally, general principles of organic chemistry, as well as specific functional moieties and reactivity, are described in *Organic Chemistry*, Thomas Sorrell, University Science Books, Sausalito, 1999; Smith and March *March's Advanced Organic Chemistry,* 5$^{th}$ Edition, John Wiley & Sons, Inc., New York, 2001; Larock, *Comprehensive Organic Transformations*, VCH Publishers, Inc., New York, 1989; Carruthers, *Some Modern Methods of Organic Synthesis,* 3$^{rd}$ Edition, Cambridge University Press, Cambridge, 1987; the entire contents of each of which are incorporated herein by reference.

Disclosed herein are scale-inhibition compositions that may be useful in a variety of detergents. Examples of detergents include, but are not limited to, dishwashing detergents, automatic dishwashing detergents, laundry detergents, bottle wash and clean-in-place (CIP) detergents. The scale-inhibition compositions typically comprise at least two acrylic acid polymers. In some embodiments, the compositions comprise one or more sequestrating agents, such as an aminocarboxylic acid or phosphonic acid. The scale-inhibition compositions and the detergents may be in solid (e.g., powder or tablet) and/or liquid form, respectively.

The term "acrylic acid polymer" as used herein means a polymer of substituted or unsubstituted acrylic acid and salts thereof. The acrylic acid polymers may include both homopolymers and copolymers. The polymers may comprise a series of monomer units that may be substituted, unsubstituted or both. Examples of suitable substituted acrylate monomers include, but are not limited to, alkyl substituted acrylates. The term "alkyl" as used herein, means a straight or branched, saturated hydrocarbon chain. Preferred alkyls include 1 to 30 carbons. Representative examples of alkyl include, but are not limited to, methyl, ethyl, n-propyl, isopropyl, n-butyl, sec-butyl, iso-butyl, tert-butyl, n-pentyl, isopentyl, neopentyl, n-hexyl, 3-methylhexyl, 2,2-dimethylpentyl, 2,3-dimethylpentyl, n-heptyl, n-octyl, n-nonyl, n-decyl, and C10-C30 alkyl. Examples of suitable alkyl substituted acrylates include, but are not limited to, methacrylate, ethyl acrylate, and butyl acrylate. Examples of copolymers include, but are not limited to, copolymers of unsubstituted acrylate and substituted acrylate, such as polyacrylate/polymethacrylate copolymer, and the copolymers of acrylate and another anionic monomer, such as polyacrylate/polymaleate, polyacrylate/polyacrylamide, and polyacrylate/polystyrene copolymers.

The scale-inhibition composition may have a first acrylic acid polymer and a second acrylic acid polymer. Suitably, the acrylic acid polymers have average molecular weights of about 1000 to about 13000. The first acrylic acid polymer may have an average molecular weight of at least about 1000, at least about 2000, at least about 3000, at least about 4000, at least about 5000, at least about 6000, at least about 7000, at least about 8000, or at least about 9000. The first acrylic polymer may have an average molecular weight of less than about 13000, less than about 12000, less than about 11000, less than about 10000, less than about 9000, less than about 8000, less than about 7000, less than about 6000, less than about 5000, less than about 4000, less than about 3000, or less than about 2000. This may include ranges of about 1000 to about 6000, for example, about 2000 to about 5000, about 2500 to about 4500, or about 3500 to about 4500.

The second acrylic acid polymer may have an average molecular weight of at least about 4000, at least about 5000, at least about 6000, at least about 7000, at least about 8000, at least about 9000, at least about 10000, at least about 11000, or at least about 12000. The second acrylic polymer may have an average molecular weight of less than about 13000, less than about 12000, less than about 11000, less than about 10000, less than about 9000, less than about 8000, less than about 7000, less than about 6000, or less than about 5000. This may include ranges of about 6000 to about 12000, for example, about 6000 to about 10000, about 7000 to about 9000, or about 7500 to about 8500.

Examples of suitable commercially-available acrylic acid polymers include BASF products under the trade names of Sokalan PA25 (average molecular weight 4000 Da), Sokalan PA30 (average molecular weight 8000), and Sokalan CP 12S (average molecular weight 3000); and Acusol 445 by Rohm and Haas (average molecular weight 4500).

The scale-inhibition composition may comprise at least about 1%, at least about 2%, at least about 3%, at least about 4%, at least about 5%, at least about 6%, at least about 7%, at least about 8%, or at least about 9% by weight of the first polymer. The scale-inhibition composition may comprise less than about 10%, less than about 9%, less than about 8%, less than about 7%, less than about 6%, less than about 5%, less than about 4%, less than about 3%, or less than about 2% by weight of the first polymer. The first polymer may be present in an amount of about 1% to about 10% by weight of the scale-inhibition composition. For example, the first polymer may be present in an amount of about 2% to about 8%, about 3% to about 7%, or about 4% to about 6% by weight of the composition. Preferably, the first polymer is present in an amount of about 3% to about 7% by weight of the scale-inhibition composition.

The scale-inhibition composition may comprise at least about 0.5%, at least about 1%, at least about 2%, at least about 3%, at least about 4%, at least about 5%, at least about 6% by weight of the second polymer. The scale-inhibition composition may comprise less than about 7%, less than about 6%, less than about 5%, less than about 4%, less than about 3%, less than about 2%, or less than about 1% by weight of the second polymer. The second polymer may be present in an amount of about 0.5% to about 7% by weight of the scale-inhibition composition. For example, the second polymer may be present in an amount of about 0.5% to about 6%, about 1% to about 5%, or about 1% to about 4% by weight of the composition. Preferably, the second polymer is present in an amount of about 1% to about 4% by weight of the scale prevention composition.

The weight ratio of the first polymer to the second polymer can range from about 1:5 to about 5:1, for example from about 1:1 to about 5:1, from about 1:1.5 to about 4:1, or from about 1.5:1 to about 3:1. Preferably, the weight ratio of the first polymer to the second polymer is from about 1.5:1 to about 3:1.

The scale-inhibition composition can also comprise at least one aminocarboxylic acid or salt thereof. As used herein, "aminocarboxylic acid or salt thereof" means a compound containing one or more primary, secondary, or tertiary amine groups connected through carbon atoms to one or more carboxyl groups. Suitable aminocarboxylic acids include at least one of methylglycine diacetic acid (MGDA), glutamic acid diacetic acid (GLDA), diethylene triamine pentaacetic acid (DTPA), hydroxyethyl ethylene diamine triacetic acid (HEDTA), ethylenediaminetetraacetic acid (EDTA), and a combination thereof. Preferred aminocarboxylic acids include MGDA, GLDA, and salts thereof. The scale-inhibition composition may comprise at least about 0.5%, at least about 1%, at least about 2%, at least about 3%, at least about 4%, at least about 5%, at least about 6%, at least about 7%, at least about 8%, or at least about 9% by weight of the aminocarboxylic acid. The scale-inhibition composition may comprise less than about 10%, less than 9%, less than about 8%, less than about 7%, less than about 6%, less than about 5%, less than about 4%, less than about 3%, less than about 2%, or less than about 1% by weight of the aminocarboxylic acid. Typically, the aminocarboxylic acid can be present in an amount of about 0.5% to 10% by weight of the scale-inhibition composition. For example, aminocarboxylic acid can be present in an amount of about 1% to about 10%, about 1% to about 8%, or even about 3% to about 5% by weight of the composition. Preferably, the aminocarboxylic acid is present in an amount of about 3% to about 5% by weight of the scale-inhibition composition.

The scale-inhibition composition can also comprise at least one phosphonic acid or salt thereof. As used herein, "phosphonic acid" means a compound having one or more —(P═O)$(OH)_2$ substituents in its structure. Examples of suitable phosphonic acid include at least one of 1-hydroxyethane 1,1-diphosphonic acid (HEDP), amino tris(methylenephosphonic acid) (ATMP), ethylenediamine tetra(methylene phosphonic acid) (EDTMP), tetramethylenediamine tetra(methylene phosphonic acid) (TDTMP), hexamethylenediamine tetra(methylene phosphonic acid) (HDTMP), diethylenetriamine penta(methylene phosphonic acid) (DTPMP), and combinations thereof. Preferred phosphonic acids include diphosphonic acids, such as HEDP and salts thereof. The scale-inhibition composition may comprise at least 0.1%, at least about 0.5%, at least about 1%, at least about 2%, at least about 3% by weight of the phospohonic acid. The scale-inhibition composition may comprise less than about 4%, less than about 3%, less than about 2%, less than about 1%, or less than 0.5% by weight of the phosphonic acid. Typically, the phosphonic acid can be present in an amount of about 0.1% to 4% by weight of the scale-inhibition composition. For example, the phosphonic acid can be present in an amount of about 0.5% to about 4%, about 0.5% to about 3%, or even about 0.5% to about 2% by weight of the composition. Preferably, the phosphonic acid is present in an amount of about 0.5% to about 2% by weight of the scale-inhibition composition.

The weight ratio of the aminocarboxylic acid to the phosphonic acid can range from about 1:2 to about 10:1, for example from about 1:1 to about 5:1, from about 2:1 to about 5:1, or from about 3:1 to about 5:1. Preferably, the weight ratio of the aminocarboxylic acid to the phosphonic acid is from about 3:1 to about 5:1.

It is desirable to control the phosphorus content at a low level in the scale-inhibition compositions. Replacing phosphate builders in detergent formulations reduces the phosphorus concentration in wastes and protects the environment from eutrophication. Advantageously, the present scale-inhibition compositions having low element phosphorus content are effective in inhibiting scale formation on a variety of substrates. The term "element phosphorus content" means the total content of phosphorus element in the scale-inhibition composition. Typically, the compositions have an element phosphorus content of no more than about 5%. For example, the element phosphorus content may be no more than about 4%, no more than about 3%, no more than about 2%, no more than about 1%, no more than about 0.9%, no more than about 0.8%, no more than about 0.7%, no more than about 0.6%, no more than about 0.5%, no more than about 0.4%, no more than about 0.3%, no more than about 0.2%, or no more than about 0.1% by weight of the composition. Preferably, the element phosphorus content is no more than about 1% by weight of the scale-inhibition compositions. In one embodiment, the compositions do not include additional phosphate or any phosphorus containing component other than phosphonic acid.

In one embodiment, the scale-inhibition composition comprises: a first acrylic acid polymer having an average molecular weight of about 3000 to about 6000 in an amount of about 1% to about 10% by weight of the composition; a second acrylic acid polymer having an average molecular weight of about 6000 to about 10000 in an amount of about 0.5% to about 7% by weight of the composition; an amino carboxylic acid selected from methylglycine diacetic acid (MGDA), glutamic acid diacetic acid (GLDA), diethylene triamine pentaacetic acid (DTPA), hydroxyethyl ethylene diamine triacetic acid (HEDTA), ethylenediaminetetraacetic acid (EDTA), and combinations thereof in an amount of about 1% to about 8% by weight of the composition; and an organodiphosphonic acid selected from 1-hydroxyethane 1,1-diphosphonic acid (HEDP), amino tris(methylenephosphonic acid) (ATMP), ethylenediamine tetra(methylene phosphonic acid) (EDTMP), tetramethylenediamine tetra(methylene phosphonic acid) (TDTMP), hexamethylenediamine tetra(methylene phosphonic acid) (HDTMP), diethylenetriamine penta(methylene phosphonic acid) (DTPMP), and combinations thereof in amount of about 0.5% to about 4% by weight of the composition.

In another embodiment, the scale-inhibition composition comprises: a first acrylic acid polymer having an average molecular weight of about 4000; a second acrylic acid polymer having an average molecular weight of about 8000; MGDA; and HEDP.

The present scale-inhibition composition can further include a base, such as sodium hydroxide, sodium metasilicate, or sodium carbonate. The scale-inhibition composition may comprise at least 5%, at least about 10%, at least about 15%, at least about 20%, at least about 25% by weight of the base. The scale-inhibition composition may comprise less than about 30%, less than about 25%, less than about 20%, less than about 15%, or less than about 10% by weight of the base. Typically, the base can be present in an amount of about 5% to 30% by weight of the scale-inhibition composition. For example, the base can be present in an amount of about 5% to about 30%, about 5% to about 25%, or about 5% to about 20% by weight of the composition. Preferably, the base is present in an amount of about 5% to about 20% by weight of the scale-inhibition composition.

The scale-inhibition compositions can be included in a variety of detergent compositions. For example, the scale-inhibition composition may be prepared first by mixing the components in solid or liquid forms to form a blend, and the blend is then included in a detergent composition. Alternatively, the components of the scale-inhibition composition may be added separately during the preparation of the detergent composition. In one embodiment, a liquid detergent is prepared as follows: prepare an alkali solution of desired concentration while maintaining the temperature of the solution below about 35-40° C.; add the components of the scale-inhibition composition one by one to the alkali solution with continuous stirring to mix the components thoroughly; and then add other ingredients of the detergent (e.g., balance water, defoamer, etc.). In one embodiment, a power detergent is prepared as follows: add powder components (e.g., in the form of a prill and granule) into a ribbon blender or mixer; mix the components in homogenous mixture; sieve or mill the mixture to reduce lumps that form.

Examples of detergent compositions include dishwashing compositions, automatic dishwashing compositions, laundry detergent compositions, bottle wash compositions, and clean-in-place (CIP) detergent compositions. Suitable detergent compositions include liquid detergents (such as those under the trade names of Suma Nova L6, Suma Ultra L2, Suma Alu L10, and Suma Super L1, commercially available from Diversey Inc., Sturtevant, Wis.), and powder detergents (such as those under the trade names of Suma Revoflow Max P1 and Suma Revoflow Clean P6, commercially available from Diversey Inc., Sturtevant, Wis.). When included in a detergent composition, the scale-inhibition compositions typically comprise about 1.0% to about 30% by weight of the detergent composition. For example, the scale-inhibition composition may be present in an amount of at least about 1%, at least about 5%, at least about 10%, at least about 15%, at least about 20%, at least about 25% by weight of the detergent composition. The scale-inhibition composition may be present in an amount of less than about 30%, less than about 25%, less than about 20%, less than about 15%, less than about 10%, or less than about 5% by weight of the detergent composition.

The detergent compositions may also include conventional ingredients, for example, selected from alkalinity sources, surfactants, bleaches, defoamers, rinse aid, and enzymes. The detergent composition can be in a form of a liquid, powder, or tablet.

Suitable alkalinity sources include alkali metal hydroxides, e.g. sodium or potassium hydroxides, and alkali metal silicates, e.g. sodium metasilicate. Particularly effective is sodium silicate having a mole ratio of $SiO_2$:$Na_2O$ of from about 1.0 to about 3.3. The pH of the detergent composition typically is in the alkaline region, preferably at ≥9, more preferably at ≥10.

Surfactants may enhance cleaning and/or to act as defoamer. Suitable surfactants include cationic surfactant, anionic surfactants, amphoteric surfactants, zwitterionic surfactants, nonionic surfactants, and mixtures thereof. Examples of suitable surfactants include those disclosed in U.S. Pat. No. 7,375,068 and U.S. Pat. No. 7,943,565, which are incorporated by reference herein in their entireties. The surfactant may be present in a concentration of about 0% to about 10% by weight, preferably from 0.5% to about 5% by weight, most preferably from about 0.2% to about 2% by weight.

Suitable bleaches include halogen-based bleaches or oxygen-based bleaches. More than one kind of bleach may be used. As halogen bleach, alkali metal hypochlorite may be used. Other suitable halogen bleaches are alkali metal salts of di- and tri-chloro and di- and tri-bromo cyanuric acids. Suitable oxygen-based bleaches are the peroxygen bleaches, such as sodium perborate (tetra- or monohydrate), sodium carbonate or hydrogen peroxide. The amounts of hypochlorite, dichloro cyanuric acid and sodium perborate or percarbonate preferably do not exceed 15% and 25% by weight, respectively, e.g. 1-10% and 4-25% and by weight, respectively.

For solid detergents in the form of a powder, granulated powder, tablet, briquette or solid block the use of a solid defoaming agent might be preferred. Examples of suitable solid defoamers are: SILFOAM® SP 150 (Wacker Chemie AG; Silicone Antifoam Powder) or DC 2-4248S (Dow Corning; powdered antifoam).

For solid detergents, such as those in the form of a tablet, a binder may be included in the detergent composition. Advantageously, the binder may comprise a crosslinked acrylic acid polymer having a weight average molecular weight (Mw) of at least 500,000, as described in co-filed application U.S. Ser. No. 62/023,602 to Parte et al., "TABLET DISHWASHING DETERGENT AND METHODS FOR MAKING AND USING THE SAME," filed Jul. 11, 2014, which is incorporated by reference herein in its entirety.

Suitable rinse aids include, for example, polysaccharide (such as those disclosed in WO 2008/147940), cationic starch (such as those disclosed in WO 2010/065483), and the quaternary ammonium salts disclosed in the co-filed application U.S. Ser. No. 62/023,603 to Parte et al., "DISHWASHING DETERGENT AND METHODS OF MAKING AND USING THE SAME," filed Jul. 11, 2014. Suitable commercial rinse aid includes modified tapioca starch (e.g. Cato 308), cationic starch such as Vector IC 27216 (Roquette), and Varisoft 222LM (Evonik). Publications WO 2008/147940, WO 2010/065483, and U.S. Ser. No. 62/023,603 are incorporated by reference herein in their entireties.

Examples of enzymes include, but are not limited to, amylolytic enzymes, proteolytic enzymes, and combinations thereof. The enzymes usable herein can be those derived from bacteria or fungi, as known in the art.

Minor amounts of various other components may be present in the detergent composition. These include solvents, and hydrotropes such as ethanol, isopropanol and xylene sulfonates, flow control agents; enzyme stabilizing agents; anti-redeposition agents; corrosion inhibitors; and other functional additives.

The scale-inhibition compositions may inhibit scale formation on a variety of wares, when the compositions are applied to at least a portion thereof. More particularly, the scale-inhibition compositions may inhibit formation of scales when the compositions are added to detergents and mixed with water in order to clean wares. This cleaning may occur in a ware washing machine or automatic dish washing machine. Commercial examples of these machines include, but are not limited to, Meiko Single Tank Dishwash machine (Model No. Dv80.2).

The term "inhibit" means to prevent or slow the formation of scales on a substrate. The term "inhibition" means preventing or slowing the formation of scales on a substrate. The term "inhibitory" means the ability to cause inhibition. Examples of various materials from which the substrates may be made include, but are not limited to, glass, plastic, and stainless steel. The substrates may be wares. Examples of wares include, but are not limited to, dishwares, pots, pans, silverware, cooking utensils, eating utensils, cutlery, tumblers, and crockery. The surface of the wares may be soiled after contacting or containing food or liquids. The scale-inhibition composition can be included in detergents and cleaning compositions that are used to clean the wares, for example, in an automatic washing machine.

The compositions may inhibit scale formation at water hardness levels of about 10 ppm to about 1000 ppm. For example, the compositions may be effective in inhibiting scale formation on a surface under water conditions that are generally accepted in the art as being soft (less than 50 ppm), moderately hard (about 50-120 ppm), hard (about 120-200 ppm), and very hard (greater than about 200 ppm, about 300 ppm, about 400 ppm, about 500 ppm, about 600 ppm, about 700 ppm, about 800 ppm, or about 900 ppm). The compositions are generally effective in a ware cleaning cycle in an automatic washing machine.

Typically, the results of scale inhibition can be examined visually by comparing visible deposition. In addition, the formation of scale can be assessed by instrument measurement. For example, the formation of scale (and the reduction of such formation) can be measured by weighing the substrate before and after the scale deposition. For example, scale inhibition can be measured by washing a substrate or ware with a detergent comprising no scale-inhibition composition (X) and washing a substrate or ware with the same detergent with a scale-inhibition composition (Y). The amount of precipitate formed during each wash is determined.

% Scale Inhibition=[(Weight of precipitate formed with (*X*))−(Weight of precipitate formed with (*Y*))]/(Weight of precipitate formed with (*X*)×100.

The scale-inhibition compositions may provide at least about 50%, at least about 55%, at least about 60%, at least about 65%, at least about 70%, at least about 75%, at least about 80%, or at least about 85%, at least about 86%, at least about 87%, at least about 88%, at least about 89%, at least about 90%, at least about 91%, at least about 92%, at least about 93%, at least about 94%, at least about 95%, at least about 96%, at least about 97%, at least about 98%, at least about 99%, at least about 99.25%, at least about 99.5%, at least about 99.75%, at least about 99.80%, at least about 99.85% at least about 99.90%, or at least about 99.95% scale inhibition.

With respect to a glass surface, light reflectance measurements can be used to indicate a level of solid deposit on the glass. For example, a glass surface under clean, unsoiled, and unwashed condition can be scanned for light reflectance data at a given range of wavelength. After scale formation on a clean glass (e.g., after being soiled by food and being washed in an automatic washing machine), the reflectance data can be measured at the same range of wavelength and compared to those of a clean glass. The difference in the reflectance data between the clean and the washed glasses indicates the level of scale formation during the wash.

Typically, a wavelength range of from about 300 to about 800 nm is used in the present methods to collect reflectance data and to characterize the scale inhibition effects of the present composition and method. Typically, a difference in the reflectance data of less that 10% between the clean, unwashed glass and the glasses washed with a cleaning composition having the present scale-inhibition composition can be achieved. More specifically, a glass substrate may have a first reflectance in an unsoiled condition. The glass may have a second reflectance after the unsoiled glass is washed in an automatic washing machine with water having a hardness of about 20 to about 500 ppm (e.g. about 100 ppm, about 150 ppm, about 200 ppm, about 250 ppm, about 300 ppm, about 350 ppm, or about 400 ppm) and the scale-inhibition composition, or a detergent comprising the scale-inhibition composition. The difference between the first reflectance and second reflectance may be less than about 10% measured at a wavelength of from about 300 to about 800 nm. The wavelength may be about 300 nm, about 350 nm, about 400 nm, about 450 nm, about 500 nm, about 550 nm, about 600 nm, about 650 nm, about 700 nm, about 750 nm, or about 800 nm, as measured by a suitable spectrophotometer, such as KONICA MINOLTA CM-3600D. The difference between the first reflectance and second reflectance may be less than about 10%, less than about 9%, less than about 8%, less than about 7%, less than about 6%, less than about 5%, less than about 4%, less than about 3%, less than about 2%, or less than about 1%.

Unless indicated otherwise, all concentrations are expressed as weight percentage concentrations.

EXAMPLES

Example 1

Measurement of Scale Inhibition by Filtration Method

An aqueous calcium acetate solution (10 gm/L) was prepared. Sodium bicarbonate (1% solution) was added to 400 mL of the calcium acetate aqueous solution to form a hard water solution having a water hardness of about 500 ppm. Aqueous stock solutions including each of the sequestrating agents identified in Table 1 (at 10%) were prepared. The aqueous stock solution also contained 20% sodium hydroxide. An aliquot of a sequestrating agent stock solution ("Active") was then added (2.5 g/L) to the hard water solution, and the mixture was heated to 80-85° C. with constant stirring. The mixture was then cooled to room temperature and filtered using Whatman-42 filter paper (previously weighed). The filter paper was dried at 105° C. for 3 hours and the weight of the precipitate from the mixture was determined. A blank was prepared in a similar manner without the sequestrating agent ("Blank"). The percentage scale inhibition for each agent was calculated as the following formula.

% Scale Inhibition=[(Weight of precipitate with Blank)−(Weight of precipitate with Active)]/(Weight of precipitate with Blank)×100

The scale inhibition of the sequestrating agents (each at 10% in stock solution) identified in Table 1 is shown below. NTA serves as a benchmark (about 50% inhibition).

TABLE 1

| Agent | % Scale Inhibition |
|---|---|
| Sokalan PA25 | 43.95% |
| Sokalan PA30 | 14.45% |
| Sokalan CP5 | 58.95 |
| Sokalan 12S | 100% |
| MGDA | 52.60% |

TABLE 1-continued

| Agent | % Scale Inhibition |
|---|---|
| GLDA | 18.06% |
| HEDP | 78.0% |
| NTA | 51.61% |

The scale inhibition of aqueous compositions comprising MGDA (2%), HEDP (1.4%), and each of the single polymers identified in Table 2 is shown below (balance is water).

TABLE 2

| Polymer | % Scale Inhibition |
|---|---|
| No polymer | 29.5% |
| Sokalan PA25 (2.3%) | 90.3% |
| Sokalan PA30 (2.3%) | 95.5% |
| Sokalan CP5 (2.8%) | 90.3% |
| Sokalan CP12S (2.5%) | 99.2% |

The scale inhibition of aqueous compositions comprising Sokalan PA25 (2.3%), MGDA (2%), HEDP (1.4%) and a second polymer identified in Table 3 is shown below (balance is water).

TABLE 3

| Polymer | % Scale Inhibition |
|---|---|
| Sokalan PA30 (0.9%) | 87.0% |
| Sokalan CP5 (0.9%) | 98.3% |
| Sokalan CP12S (0.5%) | 99.0% |

Example 2

Scale Inhibition Under Soiling Condition

An aqueous calcium acetate solution (10 gm/L) was prepared. Sodium bicarbonate (1% solution) was added to 400 mL of the calcium acetate aqueous solution to form a hard water solution having a water hardness of about 500 ppm. The hard water solution (500 mL) was placed in glass beakers, and soya oil (1%) was added. Formulations in Table 4 and 5 were prepared and were added separately to the hard water solution. Each solution was stirred continuously at 164 rpm for 50 hours at 60° C. The scale deposits were measured from the weight of the beakers. Table 4 shows the results using formulations 1-3 at 2.5 ml per liter (representative of hard-water detergent formulations). Table 5 shows the results using formulations 4-6 at 5 ml per liter (representative of soft-water detergent formulations).

TABLE 4

| Formulation | Active ingredients | Amount % (wt/wt) | Weight of Scale (grams) |
|---|---|---|---|
| 1 | Sodium Hydroxide | 10% | 0.16 |
| | NTA | 20% | |
| | ATMP | 1% | |
| | Water | balance | |
| 2 | Sodium Hydroxide | 10% | 0.20 |
| | MGDA | 12% | |
| | Acusol 445 | 1% | |
| | HEDP | 0.5% | |
| | Water | balance | |
| 3 | Sodium Hydroxide | 10% | 0.10 |
| | MGDA | 4% | |
| | HEDP | 1.4% | |

TABLE 4-continued

| Formulation | Active ingredients | Amount % (wt/wt) | Weight of Scale (grams) |
|---|---|---|---|
| | SokalanPA 25 | 4.5% | |
| | Sokalan PA 30 | 1.8% | |
| | Water | balance | |

TABLE 5

| Formulations | Active ingredients | Amount % (wt/wt) | Weight of Scale (grams) |
|---|---|---|---|
| 4 | Sodium Hydroxide | 20% | 0.20 |
| | NTA | 9.3% | |
| | ATMP | 0.5% | |
| | Water | balance | |
| 5 | Sodium Hydroxide | 20% | 0.23 |
| | MGDA | 6.5% | |
| | HEDP | 0.5% | |
| | Water | balance | |
| 6 | Sodium Hydroxide | 20% | 0.17 |
| | MGDA | 2% | |
| | HEDP | 1.4% | |
| | SokalanPA 25 | 2.3% | |
| | Sokalan PA 30 | 0.9% | |
| | Water | balance | |

These results indicate that the NTA free formulations with two polymers (i.e. formulations 3 and 6) have water hardness tolerance even under soiling condition. They show more effective scale inhibition than both the NTA-containing formulation (1 and 4) and the more costly MGDA formulations (2 and 5).

Example 3

Cleaning and Scale Inhibition Under Machine Ware Wash Conditions

The performance of the scale-inhibition composition was tested under actual machine ware wash conditions, and the results were compared to the NTA-based or MGDA-based compositions as follows. The cleaning and scale inhibition performances of various formulations was determined in a single tank dishwasher using artificially soiled loads and fixed assessment scales. A Elextrolux D48 or Elextrolux Wash Tech 60 single tank dishwasher machine was employed. White undecorated dessert plates (Ø=21.5 cm, Jos ten Berg), white undecorated tea-cups (Ø=21.5 cm, h=6.8 cm, Mosa Maastricht), and white undecorated Arcopal tea-cups (Ø=7.8 cm, h=6.3 cm, ARCOPAL France) were used as substrates. The substrates were soiled with breakfast cereal, mashed potatoes, or tea. All soiled articles were stored at 30° C. and 60% relative humidity for 16 to 20 hours. The soiled substrates were then cleaned at 55° C. in the dishwasher machine with formulations 1-3 (Table 4 above) at 1 mL per liter.

Soil Removal

Cleaning performance was determined by comparing the percentage clean surface of the substrate (average of at least 4 pieces) with that of a substrate washed with a reference. The visual assessments of the whole test were done by the same person. Cleaning performance is expressed on a 0% (nothing removed) to a 100% (completely clean) scale. For potato and breakfast cereal, the substrate was dipped in an iodine bath to make the remaining starch visible before visual assessment.

As shown in FIG. 1, the composition containing MGDA, HEDP, Sokalan PA 25, and Sokalan PA 30 (formulation 3)

achieved similar cleaning results as the NTA-based (formulation 1) and MGDA-based (formulation 2) compositions for substrates soiled by tea, potato starch, and cereal.

Scale Inhibition

The scale inhibition performance of formulation 3 was also tested in a single-tank dishwasher and the results were compared to the NTA-based (formulation 1) and MGDA-based (formulation 1) compositions as follows. A Hobart AUX 70E or Hobart AUX-1300-12 single-tank dishwasher with a slide-in system was employed. The substrates used were Glasses (Ø top=6.5 cm, Ø bottom=5.1 cm, height=10.5 cm; Duralex France), stainless steel soup cups (Ø top=13.2 cm, Ø bottom=6.0 cm, height=6.5 cm; Wormax inox 1810), and glass plates (148×79×4 mm). Tap water of ca 8° German hardness (° GH) was typically used for the testing (1° GH=17.8 ppm $CaCO_3$). The formulations were added at a determined dosing amount (e.g. 1 mL per liter). The substrate typically underwent 175 washes and 300 seconds drying time. The wash was around 60 seconds at 65° C. with a rinse for 8 seconds at 80° C.

Figure 2A:
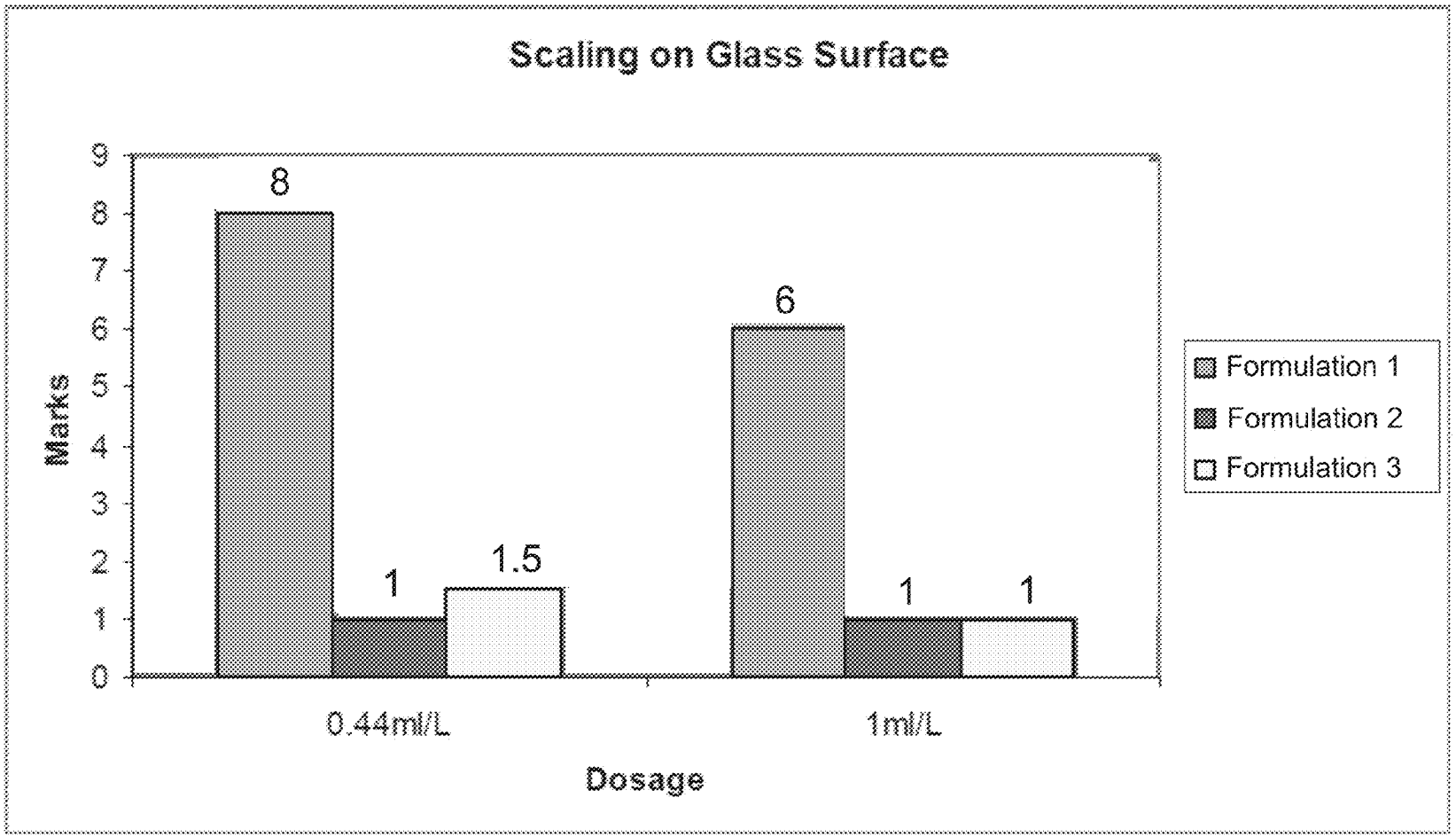
FIG. 2A and FIG. 2B show scale inhibition performance of a scale-inhibition composition (formulation 3) on glassware under machine washing conditions, compared to an NTA-based formulation (formulation 1) and an MGDA-based formulation (formulation 2) according to Example 3.
Figure 2B:
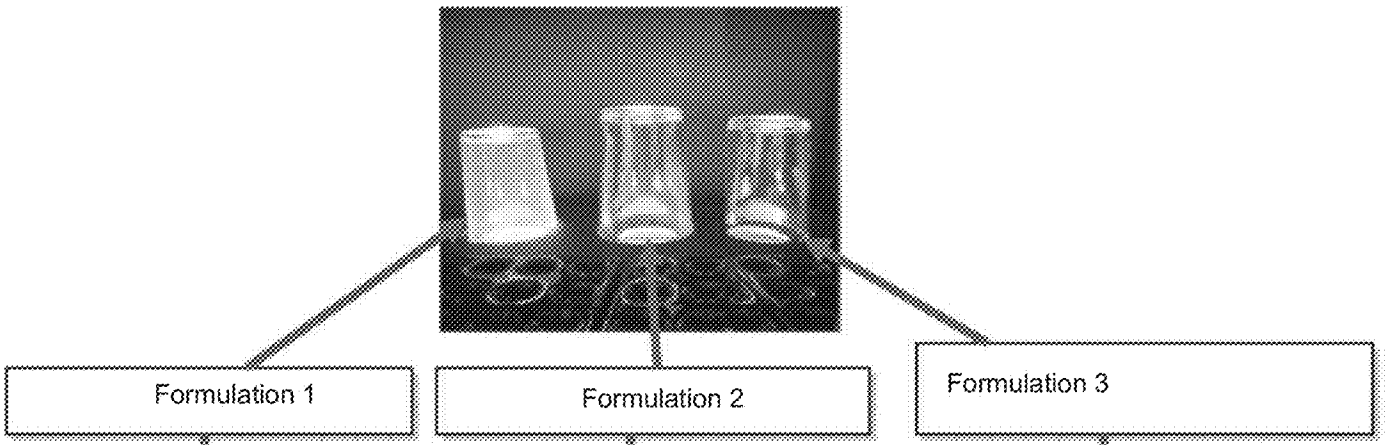

After the wash and drying, the surfaces of the substrates were visually examined and a score was assigned to each washed substrate. A higher score indicated a higher degree of deposit and, accordingly, a less effective scale inhibition. FIGS. 2A and 2B show the scale inhibition results.

Example 4

Comparison Between One-Polymer, Two-Polymer, and Phosphate-Containing Compositions Under Actual Machine Wash Conditions Using Reflectance Spectra The performance of sequestrating agents under actual machine wash conditions was tested in a single-tank dishwasher, using standardized water types and fixed assessment scales. Meiko DV 80.2 auto dishwasher machine was used. Tested substrates include the following: glasses (Duralex France, Ø top=6.5 cm, Ø bottom=5.1 cm, height=10.5 cm); stainless steel soupcups (Wormax inox 1810, Ø top=13.2 cm, Ø bottom=6.0 cm, height=6.5 cm); glass plates (148×79×4 mm).

In general, tap water of ca 8° GH was used to fill the machine through the boiler. The wash bath temperature was set at 65° C. Tap water of ca 8° GH was typically used for the testing. The formulations to be tested were connected to the SLC dosing system and delivered at the required dosing amount (1 g/L). The formulation can be in solid (e.g., powder or tablet) or liquid form. The test can also be conducted with soiled substrates. The washing program generally involved about 175 washes and about 300 seconds drying time. Each wash generally lasted about 60 seconds at 65° C., and the rinse lasted about 8 second at 80° C.

The following aqueous formulations were tested (balance is water). Formulation P1 (a composition having two acrylic acid polymers with different average molecular weight) and two comparative formulations (each having only one polymer) were tested as follows:

| Component | P1 | P1-PA25 | P1-PA30 |
|---|---|---|---|
| Sokalan PA25 | 4.5% | 6.3% | 0% |
| Sokalan PA30 | 1.8% | 0% | 6.3% |
| MGDA | 4.0% | 4.0% | 4.0% |
| HEDP | 1.4% | 1.4% | 1.4% |
| NaOH | 15.4% | 15.4% | 15.4% |

Figure 3:
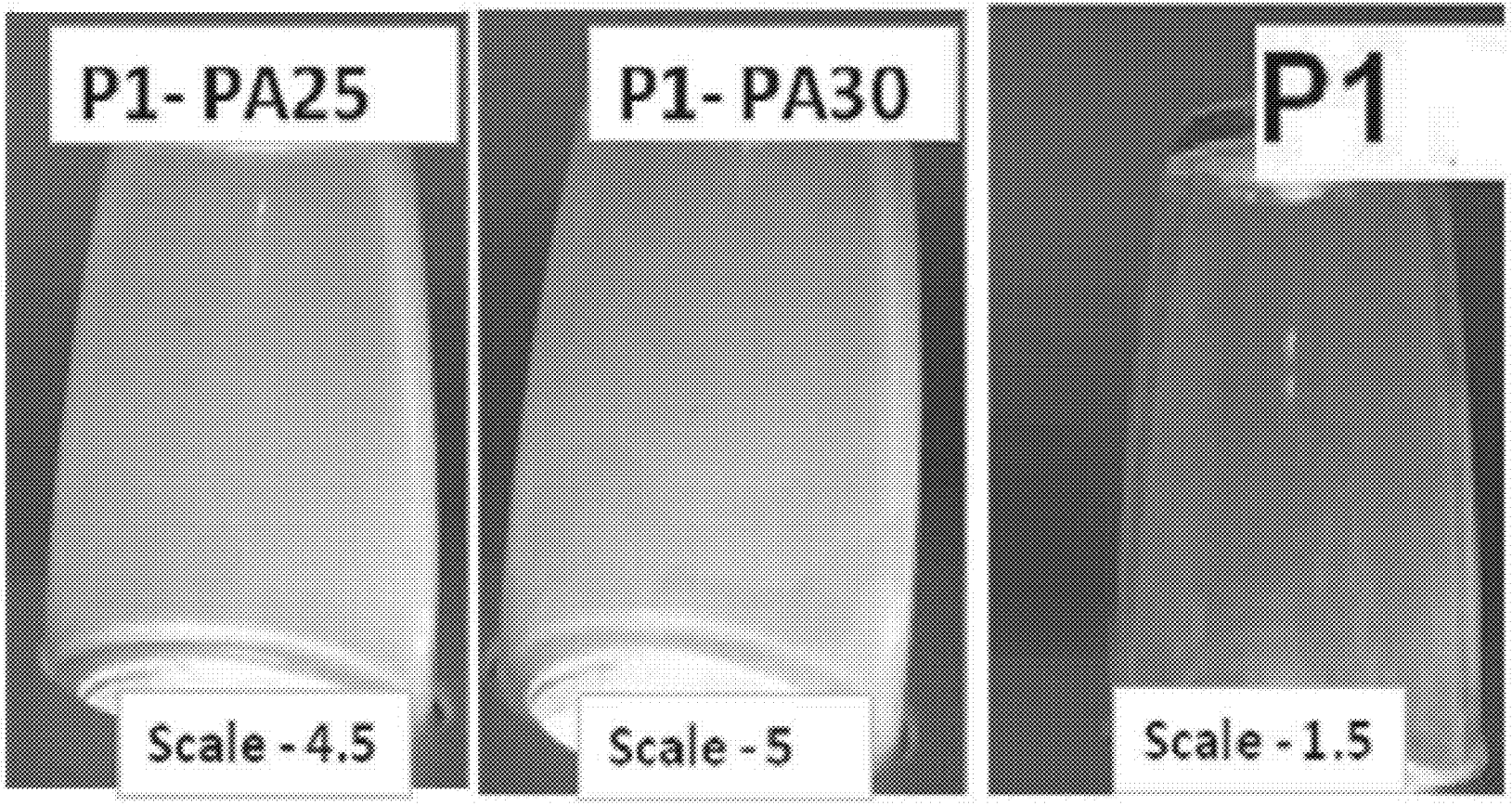
FIG. 3 compares the results of scale inhibition on glass wares using automatic washing machine of formulations set forth in Example 4. Formulations containing two polymers (P1) and single polymers (P1-PA25 and P1-PA30) were tested in a 150-wash experiment. A scale score in a range of 1-10 was assigned to each result based on visual observation, with a higher score indicating a higher degree of deposit (i.e. a less effective scale inhibition).

FIG. 3 shows the scale inhibition properties of these formulations on glass wares after an automatic machine wash. Based on visual observation, the scale deposits on the glass surfaces were scored with a range of 1-10, with a higher score indicating a higher degree of deposit and, accordingly, a less effective scale inhibition. FIG. 3 clearly demonstrates that the P1 formulation comprising two polymers achieved maximum scale inhibition and the least amount of scale deposition on the glass. This demonstrates that the combination of two polymers results in a synergistic improvement of scale inhibition over each of the polymers alone (P1-PA25 and P1-PA30) at the same concentration.

The glass coupons were further subjected to reflectance spectra analysis using Konica Minolta CM-3600d spectrophotometer (light source D65, observer 10°, equipped with Jaypak 4808 software). The wavelength range of 360 nm to 800 nm was scanned for reflectance value, which was expressed as % of light reflected from the glass surface when illuminated by a light source. Typically, reflectance values were obtained at 5 different locations on the glass substrate.

Figure 4:
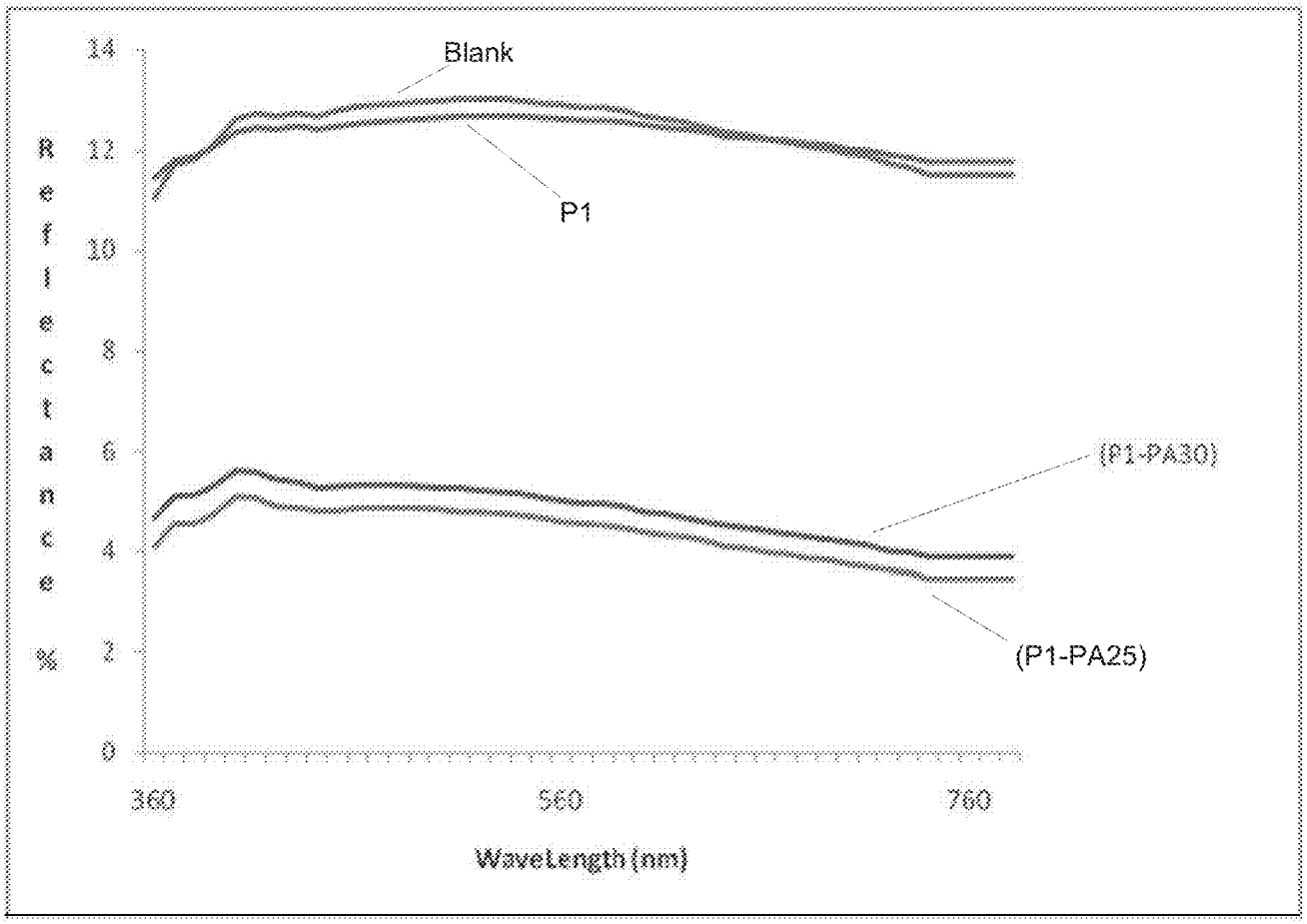
FIG. 4 shows the reflectance data of glass wares using automatic washing machine and a detergent formulation containing two acrylic acid polymers (P1) or a single acrylic acid polymer (P1-PA25 and P1-PA30) as set forth in Example 4. The formulations were tested in a 150-wash experiment, and reflectance data was measured in the 360 nm to 800 nm wavelength range. The reflectance of an unwashed clean glass ("Blank") was also measured and used for comparison.

As shown in FIG. 4, use of the P1 formulation with the two-polymer blend resulted in transmittance very close to that of blank glass, indicating a very low level of scale deposition and highly effective scale inhibition, relative to the other formulations.

Further, the scale inhibition performance of formulation P1 on glass substrate was compared to those of phosphate-containing formulations, which serve as a model of conventional sequestrating blends. Three comparative formulations (C1, C2, and C3) were used as follows (balance is water):

| Component | C1 | C2 | C3 |
|---|---|---|---|
| Sodium tripolyphosphate | 45.0% | 0% | 45.0% |
| Sodium metasilicate | 26.4% | 26.4% | 26.4% |
| HEDP | 0.4% | 0.4% | 0.4% |
| Sokalan PA 30 | 1.4% | 1.4% | 0% |
| MGDA | 1.5% | 1.5% | 1.5% |
| Sodium sulphate | 22.6% | 67.6% | 24.2% |

Figure 5:
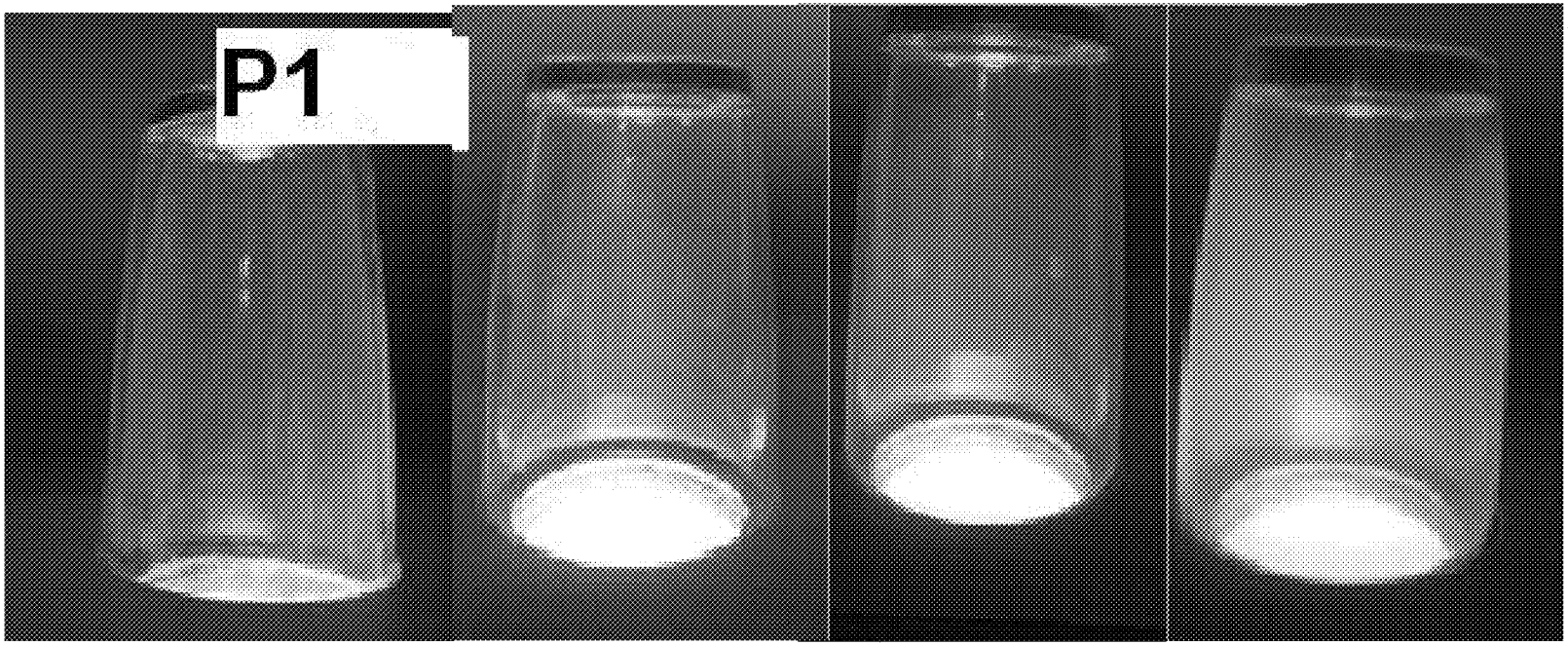
FIG. 5 shows a photograph showing scale formation after automatic washing using formulation P1 and three comparative formulations (C1-C3) as set forth in Example 4.

As shown in FIG. 5, use of P1 (two-polymer, no phosphate) resulted in the least amount of scale-inhibition compared to C1 (1 polymer with phosphate) and C2 (1 polymer, no phosphate) based on visual inspection. The glass washed by the P1 formulation was the clearest (i.e., had the least amount of scale). The scale formation was the greatest on glass washed by C3 (no polymer, with phosphate).

Figure 6:
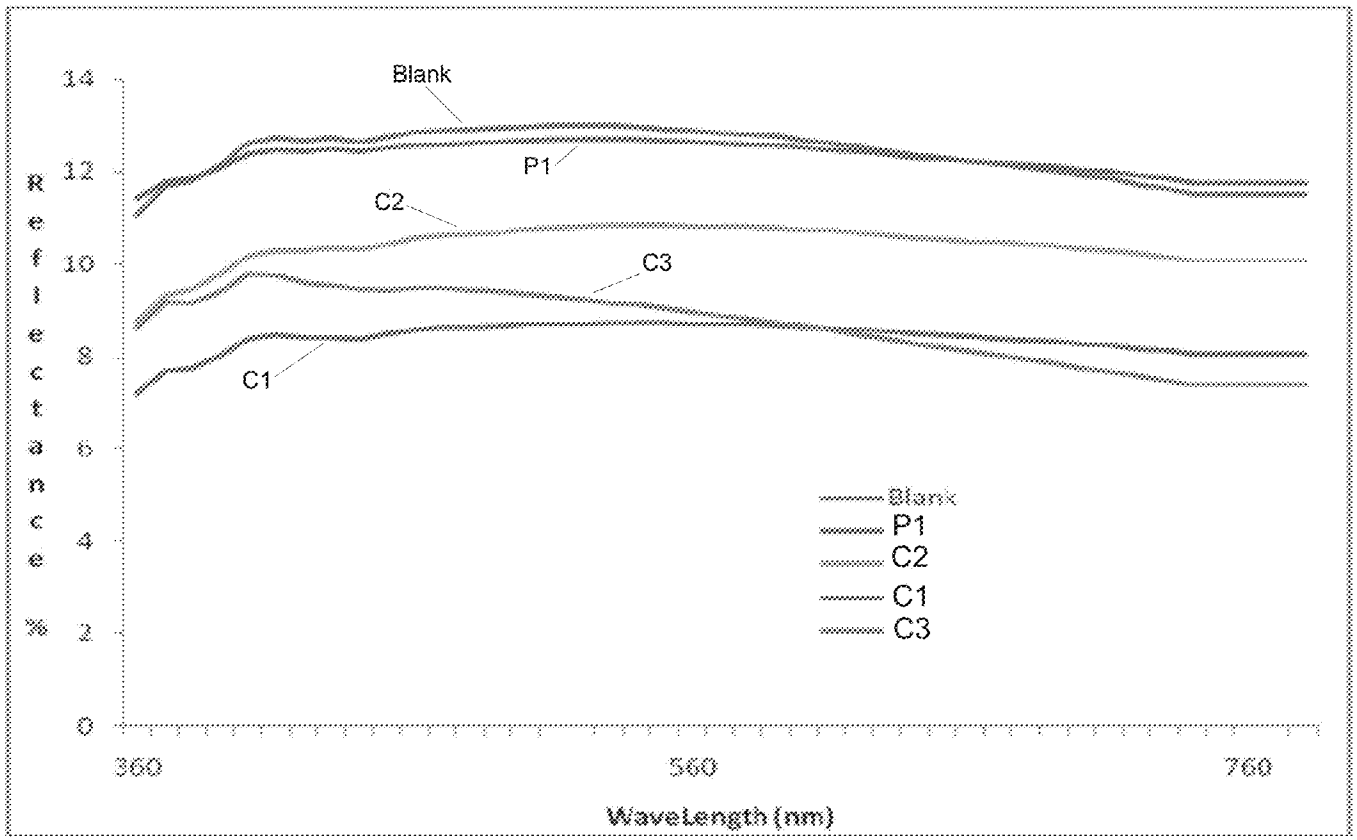
FIG. 6 shows the reflectance data of glass wares after automatic washing using formulation P1 and three comparative formulations (C1-C3) as set forth in Example 4. The formulations were tested in a 150-wash experiment, and reflectance data was measured in the 360 nm to 800 nm wavelength range. The reflectance of an unwashed clean glass ("Blank") was also measured and used for comparison.

FIG. 6 shows the reflectance spectra results of these formulations on glass wares after automatic machine wash, in comparison with formula P1. The spectra were generated using Minolta spectrophotometer under conditions similar to FIG. 4.

The P1 formulation demonstrated the most effective scale inhibition as determined by both visual inspection (clearest appearance) and reflectance data (transmittance data closest to the Blank).

Various features and advantages of the invention are set forth in the following claims.

What is claimed is:

1. A scale-inhibition composition comprising:

(a) a first acrylic acid polymer having an average molecular weight of about 3000 to about 6000;

(b) a second acrylic acid polymer having an average molecular weight of about 6000 to about 10000;

(c) an aminocarboxylic acid selected from methylglycine diacetic acid (MGDA), glutamic acid diacetic acid (GLDA), diethylene triamine pentaacetic acid (DTPA), hydroxyethyl ethylene diamine triacetic acid (HEDTA), ethylenediaminetetraacetic acid (EDTA), and a combination thereof; and (d) a phosphonic acid selected from 1-hydroxyethane 1,1-diphosphonic acid (HEDP), amino tris(methylenephosphonic acid) (ATMP), ethylenediamine tetra(methylene phosphonic acid) (EDTMP), tetramethylenediamine tetra(methylene phosphonic acid) (TDTMP), hexamethylenediamine tetra(methylene phosphonic acid) (HDTMP), diethylenetriamine penta(methylene phosphonic acid) (DTPMP), and a combination thereof.

2. The composition of claim 1, wherein the composition has an element phosphorus content of no more than 1% by weight of the composition.

3. The composition of claim 1, wherein the first acrylic acid polymer comprises a homopolymer of acrylic acid or salt thereof.

4. The composition of claim 3, wherein the first acrylic acid polymer comprises an average molecular weight of about 4000.

5. The composition of claim 1, wherein the first acrylic acid polymer is present in an amount of about 1% to about 10% by weight of the composition.

6. The composition of claim 1, wherein the second acrylic acid polymer comprises a homopolymer of acrylic acid or salt thereof.

7. The composition of claim 6, wherein the second acrylic acid polymer comprises an average molecular weight of about 8000.

8. The composition of claim 1, wherein the second acrylic acid polymer is present in an amount of about 0.5% to about 7% by weight of the composition.

9. The composition of claim 1, wherein the first acrylic acid polymer and the second acrylic acid polymer are present in a ratio of about 1.5:1 to about 3.0:1.

10. The composition of claim 1, wherein the aminocarboxylic acid is present in an amount of about 1% to about 8% by weight of the composition.

11. The composition of claim 1, wherein the aminocarboxylic acid comprises MGDA.

12. The composition of claim 1, wherein the phosphonic acid is present in an amount of about 0.5% to about 4% by weight of the composition.

13. The composition of claim 1, wherein the phosphonic acid comprises HEDP.

14. The composition of claim 1 wherein the aminocarboxylic acid is MGDA, the phosphonic acid is HEDP, and the ratio of MGDA to HEDP is about 3:1 to about 5:1.

15. The composition of claim 1, further comprising a base selected from the group consisting of sodium hydroxide, sodium metasilicate, sodium carbonate, and combinations thereof, in an amount of about 5% to about 30% by weight of the composition.

16. The scale-inhibition composition of claim 1, comprising:

(a) a first acrylic acid polymer having an average molecular weight of about 3000 to about 6000 in an amount of about 1% to about 10% by weight of the composition;

(b) a second acrylic acid polymer having an average molecular weight of about 6000 to about 10000 in an amount of about 0.5% to about 7% by weight of the composition;

(c) an amino carboxylic acid selected from the group consisting of methylglycine diacetic acid (MGDA), glutamic acid diacetic acid (GLDA), diethylene triamine pentaacetic acid (DTPA), hydroxyethyl ethylene diamine triacetic acid (HEDTA), ethylenediaminetetraacetic acid (EDTA), and a combination thereof in an amount of about 1% to about 8% by weight of the composition; and (d) a phosphonic acid selected from the group consisting of 1-hydroxyethane 1,1-diphosphonic acid (HEDP), amino tris(methylenephosphonic acid) (ATMP), ethylenediamine tetra(methylene phosphonic acid) (EDTMP), tetramethylenediamine tetra(methylene phosphonic acid) (TDTMP), hexamethylenediamine tetra(methylene phosphonic acid) (HDTMP), diethylenetriamine penta(methylene phosphonic acid) (DTPMP), and a combination thereof in an amount of about 0.5% to about 4% by weight of the composition.

17. The composition of claim 16, wherein the composition has an element phosphorus content of no more than 1% by weight of the composition.

18. The composition of claim 16, wherein the first acrylic acid polymer is present in an amount of about 3% to about 7%, the second acrylic acid polymer is present in an amount of about 1% to about 4%, the amino carboxylic acid is present in an amount of about 3% to about 5%, and the phosphonic acid is present in an amount of from about 0.5% to about 2% by weight of the composition.

19. The composition of claim 16, wherein the first acrylic acid polymer comprises an average molecular weight of about 4000, the second acrylic acid polymer comprises an average molecular weight of about 8000, the amino carboxylic acid comprises MGDA, and the organodiphosphonic acid comprises HEDP.

20. A detergent composition comprising the scale-inhibition composition of claim 1.

* * * * *